United States Patent [19]

Bergmann et al.

[11] 4,353,344

[45] Oct. 12, 1982

[54] CONTROL DEVICE FOR CONTROLLING A RECYCLING OF EXHAUST GAS OF AN INTERNAL COMBUSTION ENGINE

[75] Inventors: Horst Bergmann, Esslingen; Jörg Reddemann, Kernen, both of Fed. Rep. of Germany

[73] Assignee: Daimler-Benz Aktiengesellschaft, Stuttgart, Fed. Rep. of Germany

[21] Appl. No.: 230,801

[22] Filed: Feb. 2, 1981

[30] Foreign Application Priority Data

Feb. 2, 1980 [DE] Fed. Rep. of Germany ..... 3003885

[51] Int. Cl.[3] ..... F02M 25/06

[52] U.S. Cl. ..... 123/569; 123/568

[58] Field of Search ..... 123/569, 568, 571

[56] References Cited

U.S. PATENT DOCUMENTS

| | | | |
|---|---|---|---|
| 4,020,809 | 5/1977 | Kern et al. | 123/569 |
| 4,192,267 | 3/1980 | Cobb | 123/569 |
| 4,269,159 | 5/1981 | Skinner | 123/569 |
| 4,300,515 | 11/1981 | Straubel | 123/569 |

FOREIGN PATENT DOCUMENTS

| | | | |
|---|---|---|---|
| 1802315 | 6/1970 | Fed. Rep. of Germany | 123/569 |
| 1963235 | 6/1971 | Fed. Rep. of Germany | 123/569 |
| 2658052 | 7/1978 | Fed. Rep. of Germany | 123/569 |
| 2741834 | 3/1979 | Fed. Rep. of Germany | 123/568 |

*Primary Examiner*—Wendell E. Burns

*Attorney, Agent, or Firm*—Paul M. Craig, Jr.

[57] ABSTRACT

A control device for controlling a recycling of exhaust gases into an intake system of a self-igniting internal combustion engine which includes a signal generator, constructed as a pneumatic control slide valve mounted to a fuel injection pump. The signal generator is controlled by the respective instantaneous load conditions as a function of the rotational speed of the engine and the load on the engine by a non-reactive scanning of a position of a control rod associated with the fuel injection pump. The signal generator is coupled with the control rod and a pneumatic signal is transmitted by the signal generator in dependence upon a position of a control piston of the signal generator. The pneumatic control signal is transmitted to an adjusting member such as, for example, a pneumatic controller, compressed-air cylinder, or a valve, for each load condition of the engine associated with an exactly defined position of the control rod, with the control signal regulating an amount of recycled exhaust gases in accordance with an applied pressure.

20 Claims, 5 Drawing Figures

CONTROL DEVICE FOR CONTROLLING A RECYCLING OF EXHAUST GAS OF AN INTERNAL COMBUSTION ENGINE

The present invention relates to a control device and, more particularly, to a device for controlling a recycling of exhaust gas into an intake system of a self-igniting internal combustion engine, the device including a load signal generator constructed as a pneumatic control slide valve mounted to a fuel injection pump, with the signal generator being respectively controlled by an instantaneous load condition of the engine as a function of the number of revolutions of the engine and a load on the engine by a nonreactive scanning or measuring of a position of a control rod associate with the fuel injection pump.

A control device of the aforementioned type for controlling a recycling of exhaust gases has been proposed in, for example, Offenlegungsschrift No. 2,410,837.

The aim underlying the present invention essentially resides in providing a control device for controlling a recycling of exhaust gases of an internal combustion engine which not only enables a reduction in the reaction with respect to the control rod to such an exent that an improper change in the control characteristics will not in any case occur but also the obtaining of exactly defined switching points, so that, depending upon the requirements, two or more switching positions of an adjusting member may be represented in a direct correlation with an instantaneous position of the control rod of the fuel injection pump.

In accordance with advantageous features of the present invention, for each load condition of the internal combustion engine associated with an exactly defined position of the control rod of the fuel injection pump, a pneumatic control signal is transmitted by the load signal generator coupled with the control rod in dependence upon a position of its associated control piston to an adjusting member such as, for example, a pneumatic controller, compressed-air cylinder, or compressed-air valve. The control signal regulates the amount of recycled exhaust gases in accordance with the applied pressure. In this connection, the exhaust gases are to be recycled only while the engine runs in a partial load range and, in this partial load range of operation, only a portion of the exhaust gases is to be selected for the exhaust gas recycling step.

In order to make it possible for an unhindered return of the control rod in order to ensure that the return of the control rod is not impeded by a jammed or stucked piston, or by a piston which adheres or jams in some other manner, in accordance with further features of the present invention, the control piston of the signal generator is connected to the control rod by way of a magnetic coupling which is threaded by a threaded connection onto a corresponding thread at a free end of the control rod.

In accordance with further features of the present invention, the load signal generator includes a housing which is provided with a threaded neck extending over the control rod, with the threaded neck being adapted to be threadably screwed into a corresponding threaded bore provided in a housing of the fuel injection pump.

In order to provide for an automatic compensation of axial and angular errors between the control rod and the control piston during an advancement of the control rod and the magnetic coupling threadably joined thereto toward the control piston of the signal generator, in accordance with further advantageous features of the present invention, a disk is provided which is suspended so as to be pivotable within narrow limits about an end of the control piston on a side of the magnet of the magnetic coupling. A socket-like flaring portion of the magnetic coupling may rest on the disk during a movement toward the control piston.

In order to reduce friction and provide for an unhindered mobility of the control rod, according to the present invention, the control piston is guided with a piston clearance within a cylinder housing so that an air bearing effect is attained which additionally reduces and for all practical purposes substantially eliminates friction along an entire periphery of the piston by exposure to compressed air.

In order to bring about a rapid drop of the control pressure at an adjusting member and also to be able to attain exactly defined switching points, according to the present invention, a threaded sleeve is provided and the control piston is guided in the cylinder housing with a piston clearance with respect to the threaded sleeve which is threadably secured into the housing. The sleeve includes narrow regulating slots which are adjustable with respect to control grooves arranged in the control piston by turning the threaded sleeve. Thus by turning the threaded sleeve it is possible in accordance with specific requirements, to represent two or more switching positions of the actual ajdusting member in direct correlation with an instantaneous position of the control rod.

By virtue of the construction of the load signal generator in accordance with the present invention, it is possible to advantageously set the switching point at the engine. Moreover, it is also possible to adjust a stop for enabling an increased amount of fuel for starting purposes from the outside of the engine without disassembling the components. This latter feature is attained by virtue of the simple structure provided by the present invention and due to the fact that no changes of the basic fuel injection pump are necessary.

A further advantage of the present invention resides in the fact that there is direct control and there is a no-delay switching operation resulting from the use of compressed air wherein no reactive effect on the injection pump controller occurs. Furthermore, the control device of the present invention is flexible with respect to the pressure level, air quantity, as well as the design and arrangement of the setting or servo element. Moreover, even if the control device of the present invention were to fail, no negative effect would take place on the safe operation of the engine and/or operation of the vehicle in which the engine is disposed. An additional advantage of the present invention resides in the fact that attachment and detachment of the load signal generator are possible without any appreciable additional work.

Accordingly, it is an object of the present invention to provide a control device for controlling recycling of exhaust gases of an internal combustion engine which is simple in construction and therefore relatively inexpensive to manufacture.

Another object of the resent invention resides in providing a control device for controlling recycling of exhaust gases of an internal combustion engine which includes a load signal generator which is smaller, more lightweight, and more simply exchangeable than previously proposed load signal generators.

Yet another object of the present invention resides in providing a control device for controlling recycling of exhaust gases of an internal combustion engine which includes a load signal generator which, while simple in construction, nevertheless fulfills the requirements for ruggedness and long operating life.

A still further object of the present invention resides in providing a control device for controlling recycling of exhaust gases of an internal combustion engine which is readily utilizable in utility vehicles.

Yet another object of the present invention resides in providing a control device for controlling recycling of exhaust gases of an internal combustion engine which provides a practicable design for a load signal generator for the control device so as to ensure the existence of an efficient exhaust recycling system.

A still further object of the present inventon resides in providing a control device for controlling recycling of exhaust gases of an internal combustion engine which functions reliably under all operating conditions of the engine.

These and other objects, features, and advantages of the present invention will become more apparent from the following description when taken in connection with the accompanying drawings which show, for the purpose of illustration only, one embodiment in accordance with the present invention, and wherein.

Figure 4:
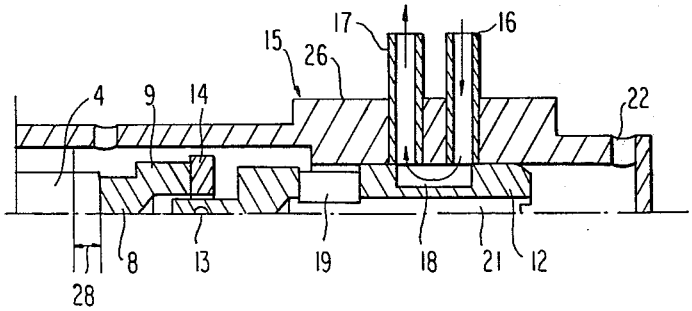
Figure 5:
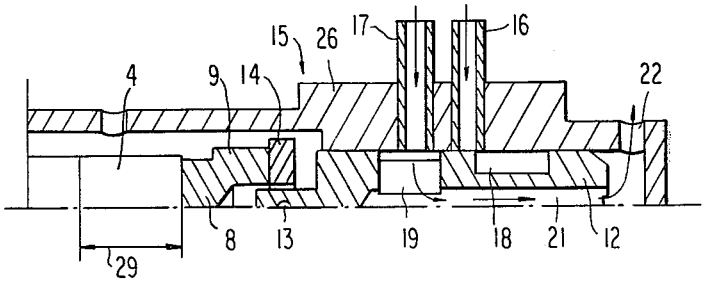

FIG. 4 is a partial cross-sectional view, on an enlarged scale, of the load signal generator of the present invention with the control rod of the fuel injection pump being at a "partial load" or idling position; and FIG. 5 is a partial cross-sectional view, on an enlarged scale, of the load signal generator of the present invention with the control rod of the fuel injection pump being at a "full load range" position.

Figure 1:
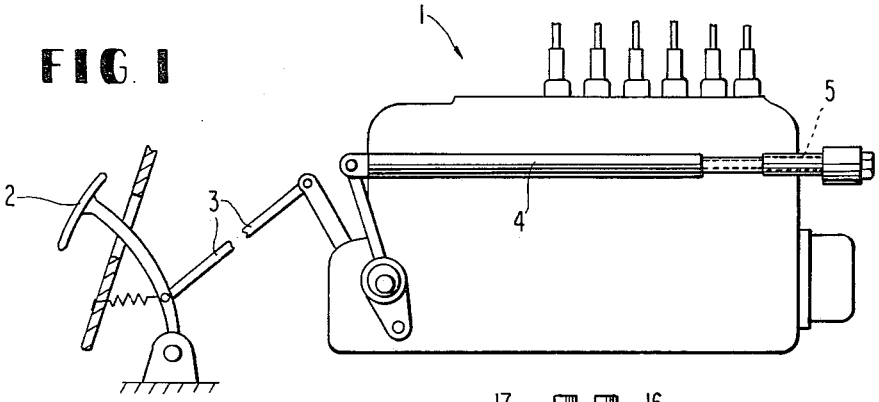
FIG. 1 is a schematic view of a fuel injection pump equipped with a load signal generator constructed in accordance with the present invention.

Referring now to the drawings wherein like reference numerals are used throughout the various views to designate like parts and, more particularly, to FIG. 1, according to this figure, a fuel injection pump generally designated by the reference numeral 1 is operable, through a linkage 3, by a gas pedal or accelerator 2. During an idling operation of an engine (not shown) to which the fuel injection pump 1 is connected, a control rod is shifted toward the left, as viewed in FIG. 1, and, under a load operation, the control rod 4 is increasingly shifted toward the right until the control rod 4 abuts an adjustable stop which limits the supply of additional starting fuel volumes.

Figure 2:
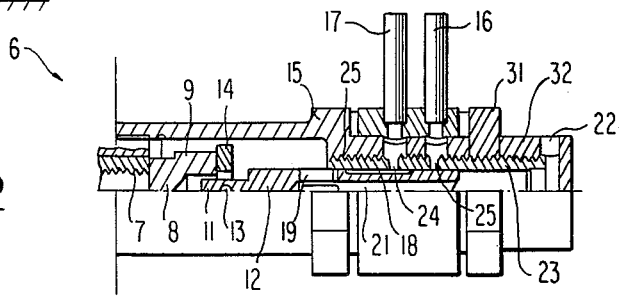
FIG. 2 is a partial cross-sectional view of a load signal generator in accordance with the present invention provided with a threaded sleeve at a "stop" position of a control rod of the fuel injection pump.

Generally, the control rod 4 arrangeed at the fuel injection pump is provided with a bore therein, with the bore being provided with a thread 5. A load signal generator generally designated by the reference numeral 6, in accordance with the present invention, is threadably secured into the connecting thread 5 in order to provide for an additional starting volume abutment. As shown in FIG. 2, a threaded portion 7 is provided at a free end of the control rod 4 with a magnetic coupling 8 being threadably mounted on the free end of the control rod 4 by way of the thread 7. The magnetic coupling 8 includes a permanent magnet; however, instead of a permanent magnet, it is also possible to employ a spring detent (not shown) disposed between a sleeve-like flaring portion 9 of the magnetic coupling 8 and a pin 11 of a control piston 12.

The magnetic coupling 8 is adapted to interrupt the connection between the control rod 4 and the control piston 12 so that, if the control piston 12 happens to jam, the jamming will not interfere with the control function of the control rod 4.

A rod 13 mounts the disk to the control piston 12 so as to enable the disk 14 to be pivotable about a longitudinal axis of the rod 13. The pivotable mounting of the disk 14 serves to compensate for small angular and axial displacement errors which occur during assembly of the components of the load signal generator 6 and/or for manufacturing tolerances of the components of the load signal generator 6. The disk 14 forms an abutment member for the magnetic coupling 8 if the control rod 4 moves in a direction toward the load signal generator 6.

Two connecting necks or sockets 16, 17 are provided at a control housing 15, with one of the connecting necks 16 serving for feeding control air from a secondary load or consumer branch of a compressed air system of the vehicle. An air conduit (not shown) is connected to the other connecting neck 17. The air conduit leads to a servo-cylinder of an adjusting member (not shown), which adjusting member may, for example, contain a throttle valve for regulating a throughflow of exhaust gases to be recycled.

The control piston 12 includes a control groove 18 which, upon a positioning of the control rod at a "partial load" (FIG. 4), establishes a connection between the two connecting necks 16, 17 and thereby transmits a pneumatic signal to the adjusting member so as to cause a return or recycling of the exhaust gases. The control piston 12 further includes an opening 19 leading to an inner bore 21 by means of which a pressure equalization is effected in the connecting neck 17 in a "full load" position (FIG. 5) of the control rod 4 through a bore 22 in the housing 15, which bore 22 leads to the outside.

As shown in FIG. 2, a threaded sleeve 23 is provided and includes control cross-sections 24, 25. The control housing and the threaded sleeve 23 each have mutually fitting threads 25 on the inside surface and outside surface, respectively, so that the threaded sleeve 23 may be threaded into the control housing 15. The threaded sleeve 23 is threadably inserted into the control housing 15 to such a depth that at about ¾ full load operation of the engine, a communication is established between the connecting neck 17 and the bore 22 leading to the outside by way of the control cross-section 24, adjacent opening 19, and inner bore 21 (FIG. 5).

Figure 3:
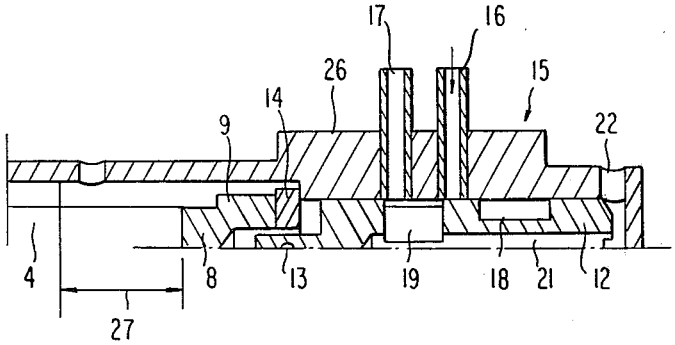
FIG. 3 is a partial cross-sectional view, on an enlarged scale, with the threaded sleeve omitted for clarity, of the load signal generator of the present invention with the control rod of the fuel injection pump being at a "start" position.

FIG. 3 provides an illustration of the position of the piston 12 and position of the control rod 4 assumed during a start-up of the internal combustion engine. As shown in FIG. 3, the control rod 4 which, in the illustrated position, has advanced the farthest toward the right comes into abutment with the disk 14 through the magnetic coupling 8 and the sleeve-like flaring portion 9. The disk 14 in turn then abuts a shoulder 26 in an interior of the control housing 15.

As clearly can be seen from FIGS. 2–5, the exhaust gas recycling only takes place in a "partial load" range of operation of the engine and, in all other instances, for example, the "stop" position of the control rod 4 (FIG. 2), the "start" position of the control rod 4 (FIG. 3), and "full load range" positon of the control rod 4 (FIG. 5), no exhaust gas recycling occurs.

The distances traversed by the control rod 4 with respect to the "stop" position (FIG. 2) from the "start", "partial load", and "full load range" positions are respectively designated by the reference numerals 27, 28, 29 in FIGS. 3, 4, and 5.

The load signal generator 6 of the control device of the present invention is set in the following manner.

At first, the load condition at which no exhaust gas recycling is to take place is set when the engine is operating at ¾ of its full load and is locked in place. By way of the displacement of the control rod 4, the control position of the control piston 12 is determined in a position corresponding approximately to the position illustrated in FIG. 4. By a turning of the threaded sleeve 23, the control cross-sections 24, 25 are now correlated to the control groove 18 in the desired fashion, namely, so that the existing control pressure of this position of the control rod 4 drops suddenly in the conduit at the connecting neck 17 leading to the adjusting member. During this step, the control pressure in the control conduit leading to the connecting neck 16 and extending from the secondary load branch of the compressed air system of the vehicle remains preserved. If the control rod 4 then returns into a position wherein the exhaust gas is recycled then, due to the air pressure which is immediately available right at that location, the adjusting member may then also be immediately pressurized or acted upon once again.

The position of the components described hereinabove may be retained by a tightening of a counter nut 31 (FIG. 2). Throughout the adjusting procedure, attention must also be devoted to the correct position of the pressure connections at the connecting necks 16 and 17. A locknut 32 wherein the bore 22 is disposed is now threaded onto the threaded sleeve 23 and simultaneously serves as a protective cap.

While we have shown and described only one embodiment in accordance with the present invention, it is understood that the same is not limited thereto but is susceptible of numerous changes and modifications as known to one having ordinary skill in the art, and we therefore do not wish to be limited to the details shown and described herein, but intend to cover all such modifications as are encompassed by the scope of the appended claims.

We claim:

1. A control device for controlling a recycling of exhaust gases into an intake system of a self-igniting internal combustion engine provided with a fuel injection pump means and a control rod means for controlling the fuel injection pump means, characterized in that the control device includes a signal generator means responsive to instantaneous conditions of the engine as a function of rotational speed and load on the engine as determined by a position of the control rod means, the signal generator means includes a control piston means for providing a pneumatic control signal to an adjusting member for each load condition of the engine associated with exactly defined positions of the control rod means so as to enable a regulation of an amount of exhaust gases recycled into the intake system of the engine in accordancewith an applied pressure of the control signal acting on the adjusting member.

2. A control device according to claim 1, characterized in that the adjusting member is a pneumatic controller.

3. A control device according to claim 1, characterized in that the adjusting member is a compressed air cylinder means.

4. A control device according to claim 1, characterized in that the adjusting member is a valve means.

5. A control device according to one of claims 1, 2, 3, or 4, characterized in that a magnetic coupling means is provided for coupling the control piston means to the control rod means.

6. A control device according to claim 5, characterized in that a free end of the control rod means is provided with a threaded portion, and in that the magnetic coupling means is provided with a threaded portion for enabling a threaded connection between the control rod means and the magnetic coupling means.

7. A control device according to claim 6, characterized in that means are provided on the control piston means for compensating for angular and axial displacement errors, and in that the magnetic coupling means includes a socket-like flaring portion adapted to rest on the compensating means during a movement of the magnetic coupling means toward the control piston means.

8. A control device according to claim 7, characterized in that the compensating means includes a disk member, and in that means are provided for pivotably mounting the disk member at an end of the control piston means.

9. A control device according to claim 8, characterized in that a control housing means is provided for accommodating the control piston means with a predetermined piston clearance.

10. A control device according to claim 9, characterized in that the control piston means includes control groove means, a threaded sleeve means is arranged between the control housing means and the control piston means, and in that the threaded sleeve means includes narrow control cross-section means adjustable with respect to the control groove means of the control piston means.

11. A control device according to claim 1, characterized in that a magnetic coupling means is provided for coupling the control piston means to the control rod means, means are provided on the control piston means for compensating for angular and axial displacement errors, and in that the magnetic coupling means includes a socket-like flaring portion adapted to rest on the compensating means during a movement of the magnetic coupling means toward the control piston means.

12. A control device according to claim 1, characterized in that a control housing means is provided for accommodating the control piston means with a predetermined piston clearance.

13. A control device according to claim 12, characterized in that the control piston means includes control groove means, a threaded sleeve means is arranged between the control housing means and the control piston means, and in that the threaded sleeve means includes narrow control cross-section means adjustable with respect to the control groove means of the control piston means.

14. A control device according to claim 12, characterized in that a first means is provided for communicating the control housing means with the adjusting member, a second means is provided for communicating the housing means with a pressure medium source, and in that means are provided in the control piston means for communicating the first and second means with each other when the control piston means is displaced to a predetermined position.

15. A control device according to claim 14, characterized in that the predetermined position of the control piston means corresponds to a position of the control rod means when the engine is operated in a partial load range.

16. A control device according to one of claims 14 or 15, characterized in that the communicating means in the control piston means is a control groove, and in that means are provided in the control piston means for effecting a pressure equalization in the first means for communicating when the control rod means is in a position corresponding to a full load range of operation of the engine.

17. A control device according to claim 16, characterized in that the pressure equalization means includes an opening provided in the control piston means at an axial spacing from the control groove means, an internal bore means provided in the control piston means in communication with the opening, and a venting bore means provided in the control housing means in communication with the internal bore means.

18. A control device according to claim 17, characterized in that a magnetic coupling means is provided for coupling the control piston means to the control rod means, means are provided on the control piston means for compensating for angular and axial displacement errors, and in that the magnetic coupling means includes a socket-like flaring portion adapted to rest on the compensating means during a movement of the magnetic coupling means toward the control piston means.

19. A control device according to claim 18, characterized in that the compensating means includes a disk member, and in that means are provided for pivotably mounting the disk member at an end of the control piston means.

20. A control device according to claim 18, characterized in that a threaded sleeve means is arranged between the housing means and the control piston means, and in that the threaded sleeve means includes narrow control cross-section means adjustable with respect to the control groove means.

* * * * *